US009885546B2

(12) United States Patent
Hu

(10) Patent No.: US 9,885,546 B2
(45) Date of Patent: Feb. 6, 2018

(54) MULTI-CONTACT TYPE POSITION DETECTION APPARATUS FOR TARGET BOARD

(71) Applicant: 3IP HANGUNG CO., LTD, Gyeonggi-do (KR)

(72) Inventor: Kwang Hu, Gyeonggi-do (KR)

(73) Assignee: 3IP HANGUNG CO., LTD, Gyeonggi-Do (KR)

( * ) Notice: Subject to any disclaimer, the term of this patent is extended or adjusted under 35 U.S.C. 154(b) by 0 days.

(21) Appl. No.: 15/129,895

(22) PCT Filed: Nov. 24, 2014

(86) PCT No.: PCT/KR2014/011297
§ 371 (c)(1),
(2) Date: Sep. 28, 2016

(87) PCT Pub. No.: WO2015/147407
PCT Pub. Date: Oct. 1, 2015

(65) Prior Publication Data

US 2017/0131068 A1 May 11, 2017

(30) Foreign Application Priority Data

Mar. 28, 2014 (KR) ..... 10-2014-0036606

(51) Int. Cl.
*F41J 5/052* (2006.01)
*A63B 63/00* (2006.01)
*F41J 1/00* (2006.01)

(52) U.S. Cl.
CPC ..... *F41J 5/052* (2013.01); *A63B 63/00* (2013.01); *F41J 1/00* (2013.01)

(58) Field of Classification Search
CPC ..... F41J 5/052; F41J 1/00; F41J 3/0057
(Continued)

(56) References Cited

U.S. PATENT DOCUMENTS 7,163,204 B1 * 1/2007 Liao ..... F41J 5/04 273/348.3

FOREIGN PATENT DOCUMENTS

CN 2180967 Y 10/1994
CN 2252976 Y 4/1997
(Continued)

OTHER PUBLICATIONS

Office action dated Mar. 22, 2017 from China Patent Office in a counterpart China Patent Application No. 201480077525.3 (all the cited references are listed in this IDS).
(Continued)

*Primary Examiner* — Aarti B Berdichevsky
*Assistant Examiner* — Rayshun Peng
(74) *Attorney, Agent, or Firm* — The PL Law Group, PLLC

(57) ABSTRACT

A multi-contact type position detection apparatus for a target board includes a first membrane board having a plurality of first signal lines formed in a first direction, a second membrane board having a plurality of second signal lines formed in a second direction, and a plurality of dots which are formed on the first membrane board or the second membrane board such that the first membrane plate and the second membrane plate are spaced at a predetermined distance from each other, wherein the plurality of dots can be arranged at a distance of "k/2±A (A is 1%~2% of k)" when a magnetic body diameter of a pin attached on the target board is "kmm".

9 Claims, 8 Drawing Sheets

(58) Field of Classification Search
USPC ..... 273/348, 348.3
See application file for complete search history.

(56) References Cited

FOREIGN PATENT DOCUMENTS

| | | | | |
|---|---|---|---|---|
| CN | 201392147 | Y | | 1/2010 |
| CN | 201583202 | U | * | 9/2010 |
| CN | 103115527 | A | | 5/2013 |
| KR | 10-2005-0037247 | A | | 4/2005 |
| KR | 10-2010-0012981 | A | | 2/2010 |
| KR | 10-2011-0054877 | A | | 5/2011 |
| KR | 20110054877 | A | * | 5/2011 |
| KR | 10-1150751 | B1 | | 6/2012 |
| KR | 10-1159545 | B1 | | 6/2012 |
| KR | 10-2013-0104700 | A | | 9/2013 |
| KR | 20130104700 | A | * | 9/2013 |

OTHER PUBLICATIONS

International Search Report for PCT/KR2014/011297.

* cited by examiner

MULTI-CONTACT TYPE POSITION DETECTION APPARATUS FOR TARGET BOARD

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2014/011297, filed Nov. 24, 2014, which claims priority to the benefit of Korean Patent Application No. 10-2014-0036606 filed in the Korean Intellectual Property Office on Mar. 28, 2014, the entire contents of which are incorporated herein by reference.

TECHNICAL FIELD

The present invention relates to a multi-contact position detection apparatus for a target board.

BACKGROUND ART

In a general dart game, an end portion of a dart pin is manufactured to be pointed for piercing a dartboard, and a result of the game is checked by a user.

Recently, Hangung (Korean hand archery) formed by combining the dart game method described above onto an archery game method has been developed. Hangung is a sport for all, which is formed by combining the advantageous aspects of Tuho which is a Korean traditional game, Kukgung (Korean archery) which is a Korean traditional event, western archery of the West, and a dart game.

The Hangung described above is a game in which a pin using a safe magnetic body (hereinafter, referred to as a Hangung pin) is used instead of a dart pin with a pointed end, the Hangung pin is thrown at a Hangung target board (1 to 10 points) a preset number of times using left hand and right hand, and an outcome of a competition is determined by comparing scores obtained by summing the scores for both hands.

Since both hands are used as described above, the Hangung may increase left and right concentration as well as flexibility and muscular strength in arms and improve balance between left and right sides of a body.

In the Hangung, a Hangung target board is necessary to precisely calculate scores. Accordingly, an electronic Hangung target board technology suitable for the Hangung pin and precisely calculating scores is ongoing.

SUMMARY

The present invention provides a multi-contact type position detection apparatus for a target board, capable of sensing a position, on a Hangung target board, of a thrown Hangung pin.

According to one aspect of the present invention, a multi-contact type position detection apparatus for detecting a position, on the target board, of a pin to be attached to a target board includes a first membrane board including a plurality of first signal lines formed in a first direction, a second membrane board including a plurality of second signal lines formed in a second direction, and a plurality of dots formed on the first membrane board and the second membrane board to allow the first membrane board and the second membrane board to be spaced apart by a certain interval. Here, when a diameter of a magnetic body of the pin is k mm, the plurality of dots are arranged at intervals of k/2±A (A is 1% to 2% of k).

Diameters of the plurality of dots may be k/8±A.

Heights of the plurality of dots may be 0.22 mm to 0.28 mm.

The first signal lines and the second signal lines may be formed on the first membrane board and the second membrane board to be orthogonal to each other.

The first signal lines and the second signal lines may be formed on the first membrane board and the second membrane board to be parallel to each other.

The first and second signal lines may be formed using one of a silver synthetic material and aluminum.

The target board may be one of an electronic dart apparatus using a pin having the magnetic body and a Hangung target board using a Hangung pin having the magnetic body.

According to embodiments of the present invention, a plurality of dots are arranged on a membrane board based on a diameter of a magnetic body which provides adhesive force to a pin, and an area to which pressure is applied is dented due to throwing of the pin and then restored to an original state, thereby preventing error which occurs when the pressure is applied and then the original state is not restored.

DETAILED DESCRIPTION

A following detailed description will be provided for comprehensive understanding of a method, an apparatus, and/or a system described herein. However, it will be merely an example, and the present invention is not limited thereto.

In the description of the embodiments of the present invention, particular detailed explanations of well-known functions or components of the related art will be omitted when it is deemed that they may unnecessarily obscure the essence of the present invention. Also, the terms described below are defined considering functions thereof in the embodiments, which may vary with intentions of a user and an operator or practice. Accordingly, the definitions thereof will be given based on the content throughout the specification. It should be understood that the terms used herein should be considered in a descriptive sense only and not for purposes of limitation. Singular expressions, unless otherwise defined, include plural expressions. Throughout the specification, the terms "comprise", "have", etc. are used herein to specify the presence of stated features, numbers, steps, operations, elements, or any or combinations thereof but do not preclude the presence or addition of one or more other features, numbers, steps, operations, elements, or any or combinations thereof.

Figure 1:
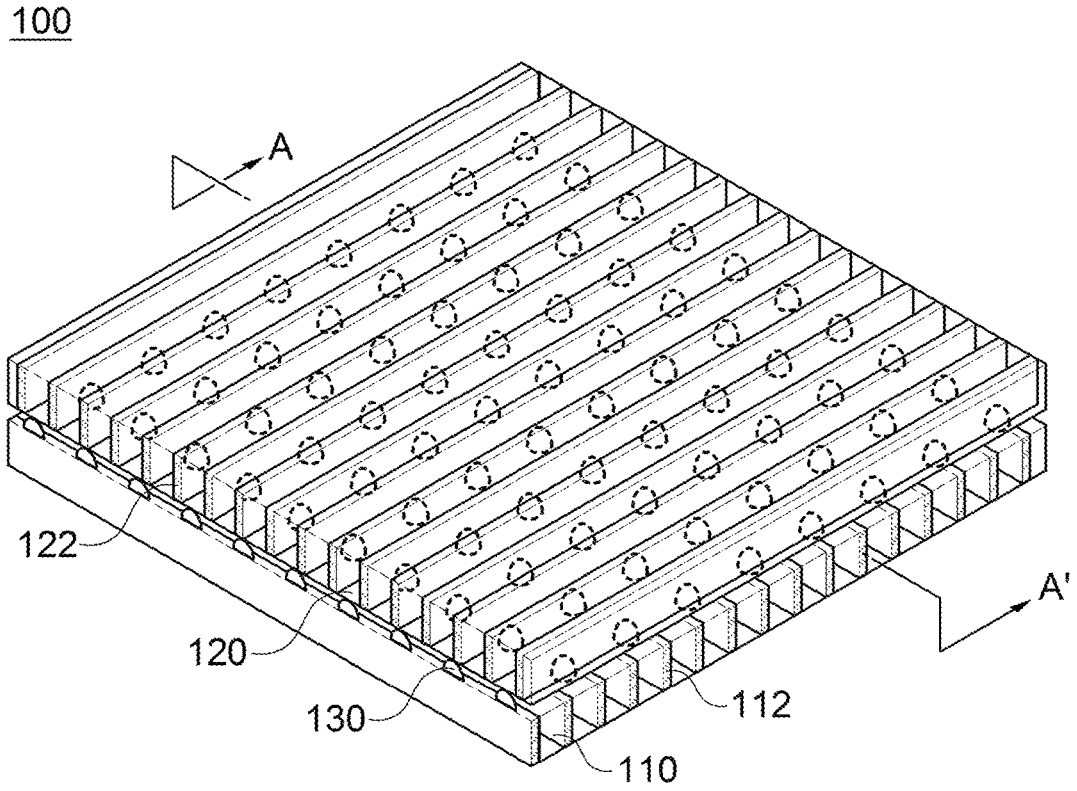
FIG. 1 is a perspective view of a multi-contact type position detection apparatus for a target board.
Figure 2:
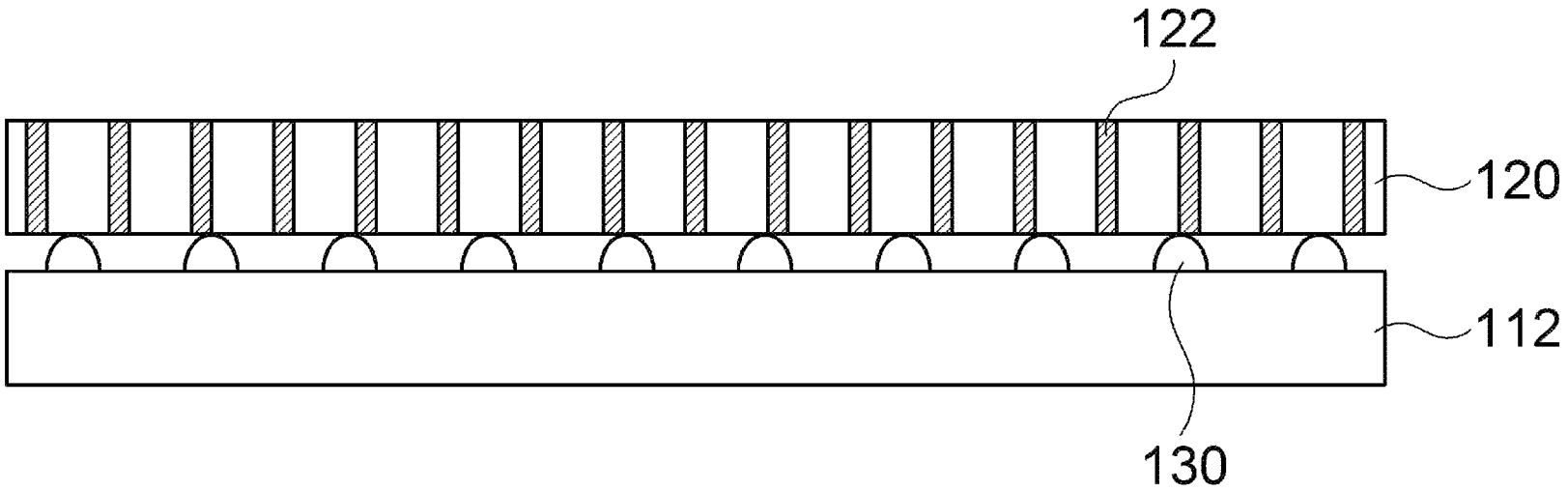
FIG. 2 is a cross-sectional view illustrating a portion AA' in FIG. 1.

FIG. 1 is a perspective view of a multi-contact type position detection apparatus for a target board. FIG. 2 is a cross-sectional view illustrating a portion AA' in FIG. 1.

As shown in FIGS. 1 and 2, a multi-contact type position detection apparatus 100 is a membrane type switching structure and may include a first membrane board 110, a second membrane board 120, and a plurality of dots 130.

In the multi-contact type position detection apparatus 100 according to a particular embodiment, the first membrane board 110 and the second membrane board 120 are coupled with the plurality of dots 130 therebetween, and pressure is applied from a particular area between the plurality of dots 130 to the second membrane board 120 in such a way that the second membrane board 120 and the first membrane board 110 are in contact with each other. Accordingly, the multi-contact type position detection apparatus 100 may sense a position of the particular area based on signals output from the first membrane board 110 and the second membrane board 120.

The first membrane board 110 may include a plurality of first signal lines 112 in a first direction.

The second membrane board 120 may include a plurality of second signal lines 122 in a second direction.

In a particular embodiment, the first and second signal lines 112 and 122 may output particular signals when a random object, for example, a Hangung pin, applies particular pressure.

Also, the first and second signal lines 112 and 122 may be formed to be orthogonal or parallel to each other. In detail, the first signal lines 112 are formed widthwise and the second signal lines 122 are formed lengthwise to intersect each other. Also, the first and second signal lines 112 and 122 may be formed parallel to each other in a direction, for example, in the form of diagonal lines slanted at a particular angle.

The plurality of dots 130 are formed on the first membrane board 110 to form a particular interval between the first membrane board 110 and the second membrane board 120. In detail, the first membrane board 110 and the second membrane board 120 may be spaced apart by as much as the height of the plurality of dots 130.

Meanwhile, arrangement positions and sizes of the plurality of dots 130 may be determined according to a diameter of an adhesive force providing means (not shown) which provides adhesive force to a random object such as a Hangung pin, for example, a magnetic body in a head portion of the Hangung pin. In detail, when the diameter of the magnetic body in the Hangung pin is k mm, the plurality of dots 130 may be arranged at intervals of k/2±A mm and may have a diameter of k/8±A mm. Here, A means a range of tolerance and may correspond to 1% to 2% of the diameter of the head portion. For example, when the diameter is 8 mm, A may be 0.08 mm to 0.16 mm.

In other words, when the diameter of the magnetic body in the Hangung pin is 8 mm and A is 0.08 mm, the diameters of the plurality of dots 130 may be 0.92 mm to 1.08 mm and the arrangement intervals of the plurality of dots 130 may be 3.92 mm to 4.4 mm. Here, the magnetic body corresponding to the adhesive force providing means of the Hangung pin may provide adhesive force between the Hangung pin and a Hangung target board when the Hangung pin is thrown at the Hangung target board and may be, for example, a permanent magnet, an induction magnet, etc.

Meanwhile, the arrangement intervals of the plurality of dots 130 may mean a distance between the center of one of the dots 130 and the center of an adjacent dot of the dots 130.

Also, the height of the plurality of dots 130 may be 0.25 mm±0.03 mm. According to the height above, the interval between the first membrane board 110 and the second membrane board 120 may be 0.22 mm to 0.28 mm.

In a particular embodiment, the first and second signal lines 112 and 122 may be formed using a material with high electric conductivity such as a silver synthetic material, aluminum, etc.

A process in which the multi-contact type position detection apparatus 100 having the structure described above senses a position will be described as follows.

First, the Hangung pin is thrown onto the second membrane board 120 in such a way that a particular pressure is applied to a position T of the second membrane board 120.

Figure 3A:
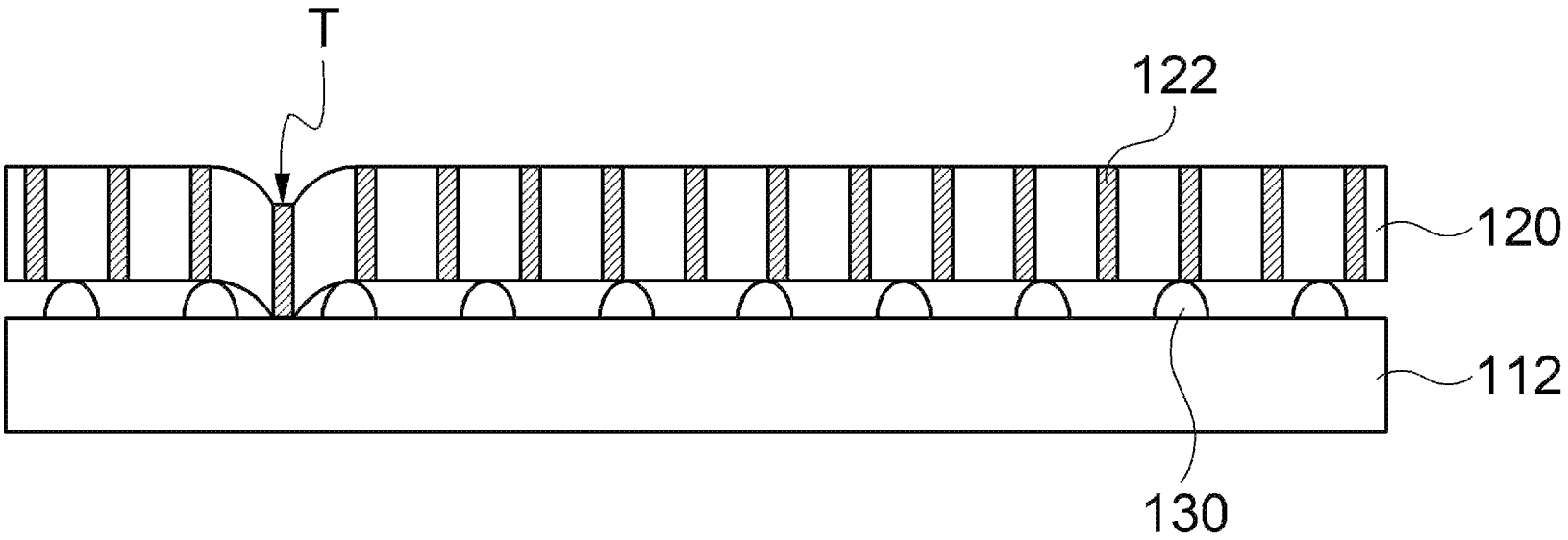
FIGS. 3*a* to 3*b* are views illustrating a multi-contact type position detection method.

After that, as shown in FIG. 3*a*, an area corresponding to the position T to which the pressure is applied is dented, and accordingly the first membrane board 110 and the second membrane board 120 momentarily come into contact with each other. The first and second signal lines 112 and 122 in the dented area described above momentarily come into contact with each other and accordingly output first and second signals.

Figure 3B:
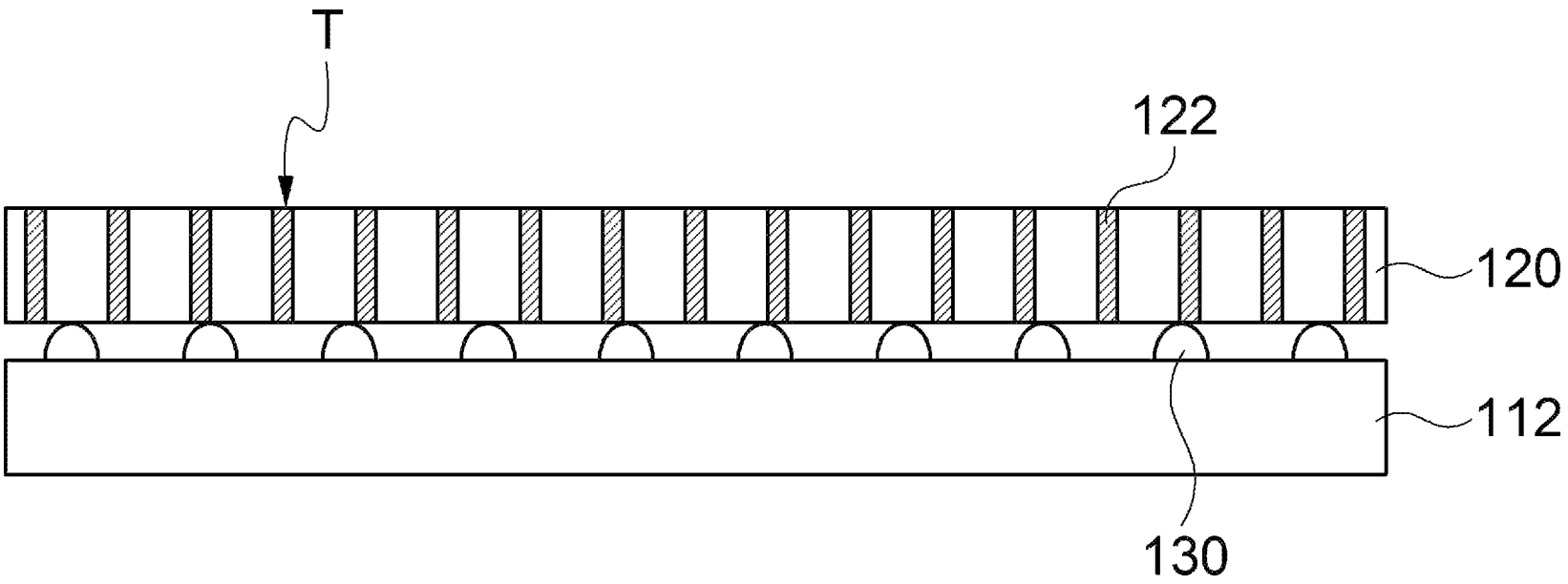

After that, the second membrane board 120 in the dented area, as shown in FIG. 3*b*, is restored to an original state.

Meanwhile, as described above, when the first and second signals are input to a control unit (not shown), the control unit may detect the position T to which the Hangung pin is thrown based on the first and second signals.

As described above, the plurality of dots 130 are arranged on the first membrane board 110 based on the diameter of the magnetic body in the Hangung pin in such a way that the Hangung pin is attached to the Hangung target board due to the magnetic body and accordingly may momentarily come into contact with the area in which the first membrane board 110 and the second membrane board 120 are attached and may be restored to an original state. Through this, it is possible to reduce error in sensing the position of the Hangung pin on the Hangung target board, that is, error occurring when the Hangung pin is not restored after the pressure is applied or the dented area does not occur when the pressure is applied. This will be described with reference to FIGS. 4*a* to 4*c*.

Figure 4A:
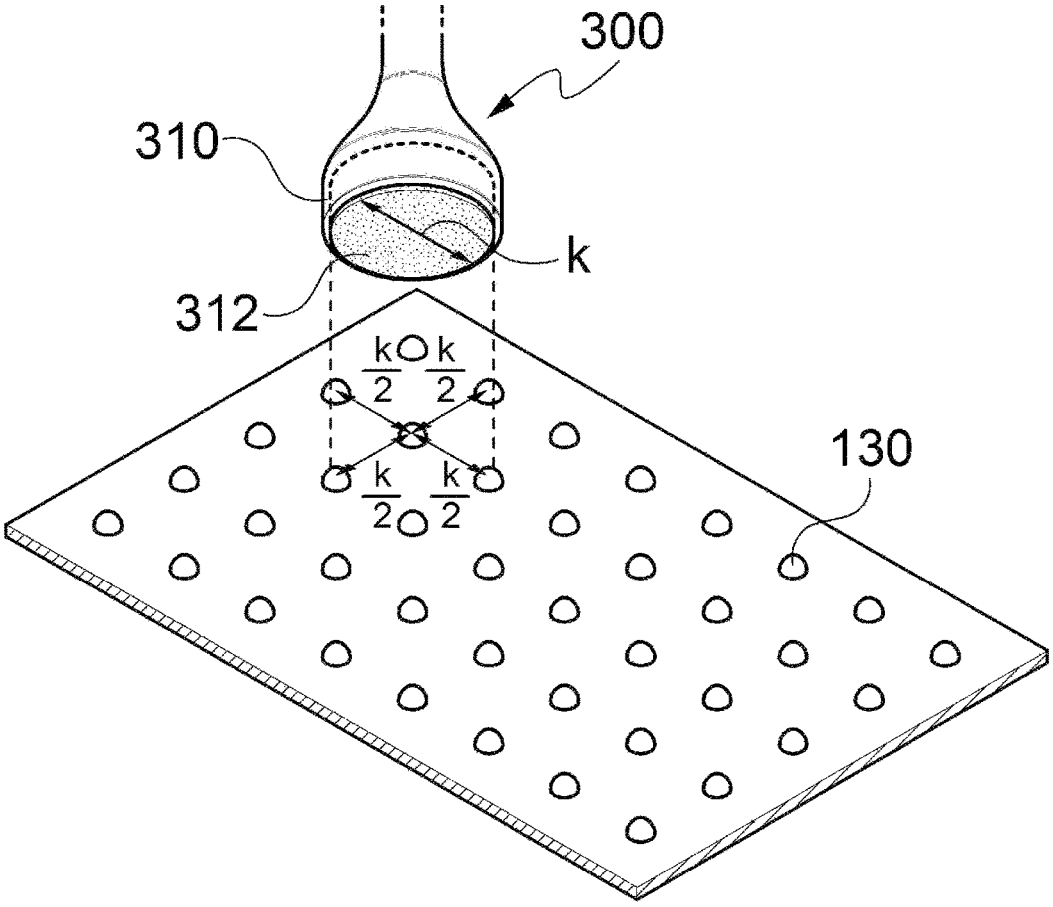
FIG. 4*a* is a view illustrating a structure in which a Hangung pin is thrown at an arrangement structure of a plurality of dots formed on a first membrane board according to an embodiment of the present invention.
Figure 4B:
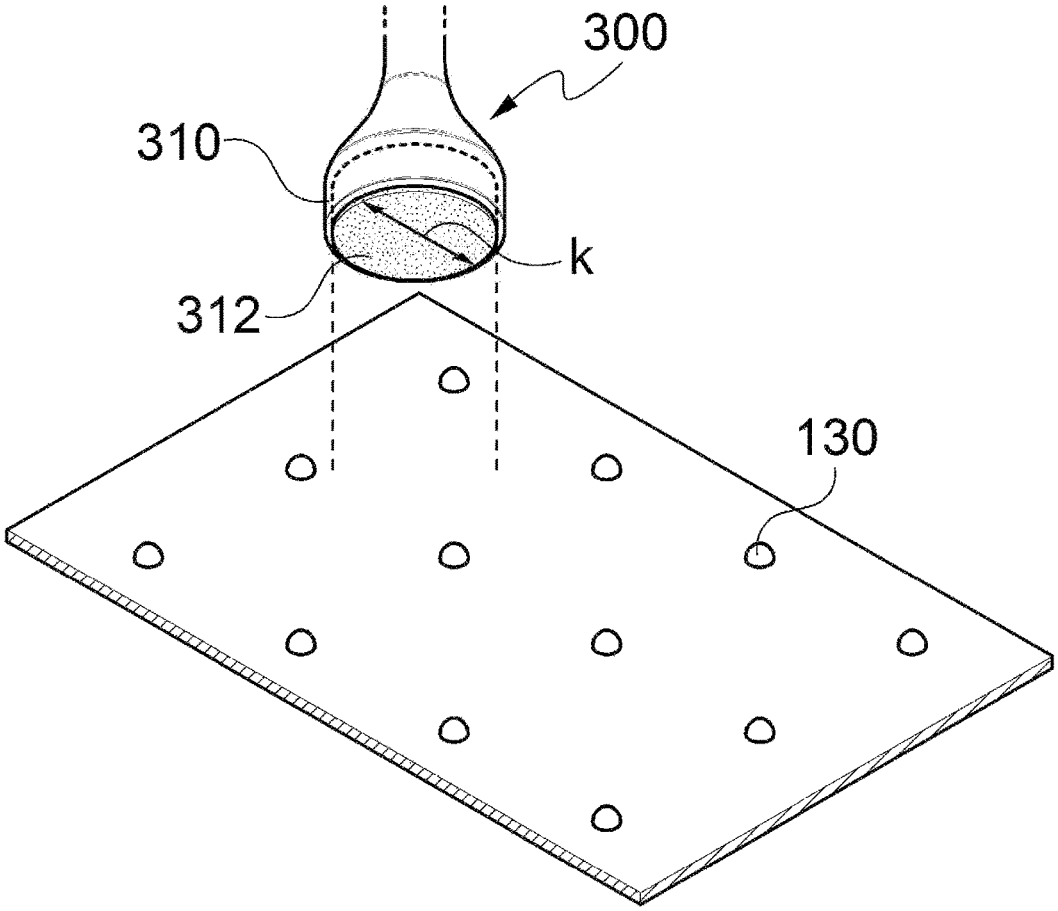
FIG. 4*b* is a view illustrating a structure in which a Hangung pin is thrown at a structure in which a plurality of dots are formed at intervals larger than the embodiment of the present invention.
Figure 4C:
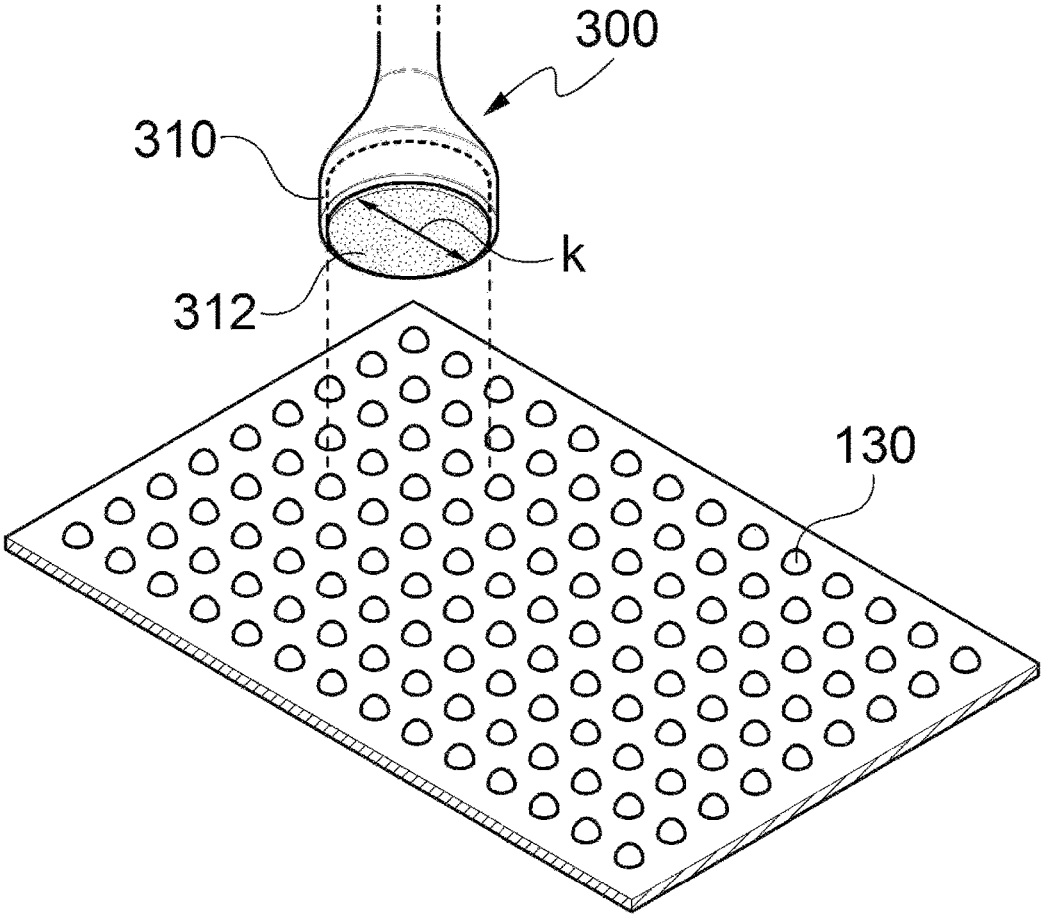
FIG. 4*c* is a view illustrating a structure in which a Hangung pin is thrown at a structure in which a plurality of dots are formed at intervals smaller than the embodiment of the present invention.

FIG. 4*a* is a view illustrating a structure in which the Hangung pin is thrown to the arrangement structure of the plurality of dots 130 formed on the first membrane board 110 according to the embodiment of the present invention. FIG. 4*b* is a view illustrating a structure in which the Hangung pin is thrown at a structure in which the plurality of dots 130 are formed at intervals larger than the embodiment of the present invention. FIG. 4*c* is a view illustrating a structure in which the Hangung pin is thrown at a structure in which the plurality of dots 130 are formed at intervals smaller than the embodiment of the present invention.

As shown in FIG. 4*a*, when a diameter of a magnetic body 312 in a head portion 310 of a Hangung pin 300 is k, intervals of the plurality of dots 130 are k/2. In this case, since a portion on the Hangung target board at which the Hangung pin 300 is thrown and applies pressure may include at least one dot, the second membrane board 120 momentarily comes into contact with the first membrane board 110 and is restored to an original state.

Meanwhile, in the structure shown in FIG. 4*a*, even though the Hangung pin 300 may apply pressure to five dots of the plurality of dots 130 at the same time, such occurrence may be considered very unlikely, considering the diameter of the magnetic body 312 of the head portion 310 and the arrangement intervals of the dots.

However, as shown in FIG. 4*b*, when the diameter of the magnetic body 312 in the head portion 310 of the Hangung pin 300 is k, the intervals of the plurality of dots 130 are formed to be larger than k/2. In this case, the Hangung pin 300 applying pressure to the five dots of the plurality of dots 130 does not occur, and, in general, the Hangung pin 300 may be thrown between two or more dots. When the Hangung pin 300 is thrown between two or more dots, since an area dented by the head portion of the Hangung pin 300 is larger than the case of FIG. 4*a*, a case in which the second membrane board 120 formed above the dots is not restored to an original state may frequently occur. As described above, since the first and second signal lines 112 and 122 of the first and second membrane board 110 and 120 continuously output signals due to the second membrane board 120 which is not restored to the original state, error may occur.

However, as shown in FIG. 4*c*, when the diameter of the magnetic body 312 in the head portion 310 of the Hangung pin 300 is k, the intervals of the plurality of dots 130 are formed to be smaller than k/2. Here, a case in which the Hangung pin 300 applies pressure to five dots of the plurality of dots 130 may frequently occur, and it is impossible to properly detect a position as shown in FIG. 4*a*.

As described above, to minimize error rate in detecting the position in the Hangung target board, as shown in FIG. 4*a*, when the diameter of the magnetic body 312 is k, it is preferable that the intervals of the plurality of dots 130 be k/2.

A structure in which the multi-contact type position detection apparatus 100 having the structure described above is applied to the Hangung target board will be described with reference to FIG. 5.

Figure 5:
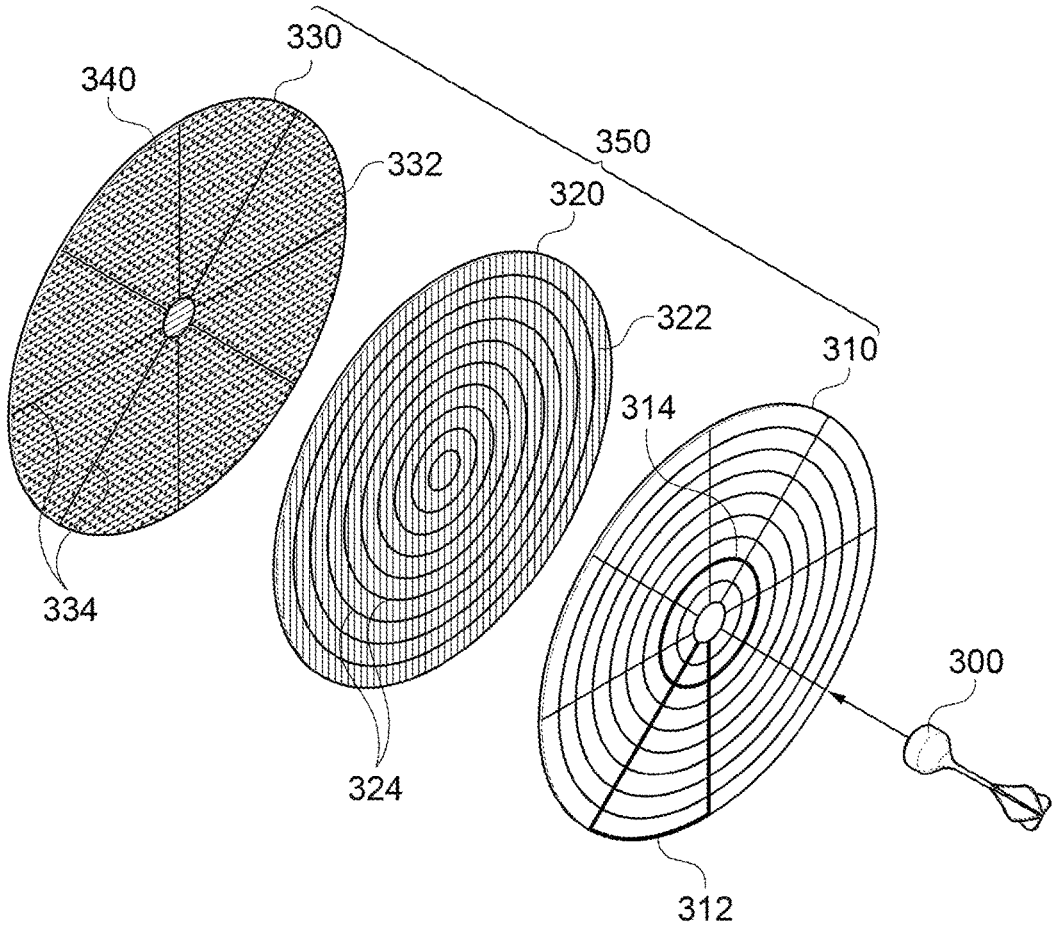
FIG. 5 is a view illustrating a structure of a Hangung target board to which a multi-contact type position detection apparatus is applied according to the embodiment of the present invention.

FIG. 5 is a view illustrating a structure of the Hangung target board 350 to which the multi-contact type position detection apparatus 100 is applied according to the embodiment of the present invention.

As shown in FIG. 5, the Hangung target board 350 may include a front portion 310, an intermediate portion 320, and a rear portion 330, and the Hangung pin 300 may be thrown onto the front portion 310 of the Hangung target board 350.

The front portion 310 may include a plurality of segments indicating score areas of the Hangung target board 350. In detail, the front portion 310 may include a plurality of fan-shaped segments 312 divided around an origin point and a plurality of circular segments 314 having different radii around the origin point.

The intermediate portion 320 may output a first signal for detecting a first position of the plurality of circular segments 314 in an area of the front portion 310 to which the Hangung pin 300 applies pressure. In detail, the intermediate portion 320 may include a plurality of signal lines 322 formed in a first direction and first output lines 324 dividing the plurality of signal lines 322 formed in shapes corresponding to the plurality of circular segments 314. In other words, signals generated by the signal lines 322 existing in a particular one of the first output lines 324 may be output through the particular first output line 324. For example, the signal lines 322 in the particular first output line 324 come into contact with signal lines 332 of the rear portion 330, and accordingly the first signal for detecting the first position may be output through the first output line 324.

In a particular embodiment, the intermediate portion 320 may correspond to the second membrane board 120 of FIG. 1, and the signal line 322 may correspond to the second signal line 122 of FIG. 1.

The rear portion 330 may output a second signal for detecting a second position of the plurality of fan-shaped segments 312 in an area of the front portion 310 to which the Hangung pin 300 applies pressure. In detail, the rear portion 330 may include a plurality of such signal lines 332 formed in a second direction and second output lines 334 dividing the plurality of signal lines 332 formed in shapes corresponding to the plurality of fan-shaped segments 312. In other words, signals generated by the signal lines 332 existing in a particular line of the second output lines 334 may be output through the particular second output line 334. For example, the signal lines 332 in a particular fan-shaped segment 312 come into contact with the signal lines 322 of the intermediate portion 320, and accordingly the second signal for detecting the second position may be output through the second output lines 334 of the particular fan-shaped segment 312.

In a particular embodiment, the rear portion 330 may correspond to the first membrane board 110 of FIG. 1, and the signal lines 332 of the rear portion 330 may correspond to the first signal lines 112 of the first membrane board 110.

The first and second signals described above may be applied to the control unit. The control unit may detect with which one of the plurality of circular segments 314 the Hangung pin 300 is in contact based on the first signal, may detect with which one of the plurality of fan-shaped segments 312 the Hangung pin 300 is in contact based on the second signal, and may derive a final thrown position of the Hangung pin 300. Accordingly, the Hangung target board 350 may output a score corresponding to an area to which the Hangung pin 300 is attached, for example, may output one of 1 to 10 points on a display portion (not shown).

Meanwhile, in the embodiment of the present invention, although it has been described as an example that the multi-contact type position detection apparatus is applied to the Hangung target board 350, the multi-contact type position detection apparatus may be applied to all target boards using a throwing means having a magnetic body. For example, when a pin having a magnetic body is used as a throwing means to be thrown at an electronic dart target board, the multi-contact type position detection apparatus according to the embodiment of the present invention may be applied to sense an area to which the pin is applied and to sense a score corresponding to the area, for example, a score corresponding to any one of 1 to 20.

Although representative embodiments of the present invention have been described in detail, it will be understood that various changes in form and details may be made therein without departing from the scope of the present invention. Therefore, the scope of the present invention is not limited to and defined by the embodiments described above but should be defined by the scope of the following claims and equivalents thereof.

The invention claimed is:

1. A multi-contact type position detection apparatus for detecting a position, on a target board, of a pin to be attached to the target board, comprising:

a first membrane board comprising a plurality of first signal lines formed in a first direction;

a second membrane board comprising a plurality of second signal lines formed in a second direction; and a plurality of dots formed on the first membrane board and the second membrane board to allow the first membrane board and the second membrane board to be spaced apart by a certain interval, wherein when a diameter of a magnetic body of the pin is k mm, the plurality of dots are arranged at intervals of k/2.

2. The apparatus of claim 1, wherein diameters of the plurality of dots are k/8±A where A is 1% to 2% of k.

3. The apparatus of claim 1, wherein heights of the plurality of dots are 0.22 mm to 0.28 mm.

4. The apparatus of claim 1, wherein the first signal lines and the second signal lines are formed on the first membrane board and the second membrane board to be orthogonal to each other.

5. The apparatus of claim 1, wherein the first signal lines and the second signal lines are formed on the first membrane board and the second membrane board to be parallel to each other.

6. The apparatus of claim 1, wherein the first and second signal lines are formed using one of a silver synthetic material and aluminum.

7. The apparatus according to claim 1, wherein the target board is one of an electronic dart apparatus using a pin having the magnetic body and a Hangung target board using a Hangung pin having the magnetic body.

8. The apparatus according to claim 1, wherein the target board is an electronic dart apparatus using a pin having the magnetic body.

9. The apparatus according to claim 1, wherein the target board is a Hangung target board using a Hangung pin having the magnetic body.

* * * * *